US005385098A

United States Patent [19]

Lindqvist et al.

[11] Patent Number: 5,385,098

[45] Date of Patent: Jan. 31, 1995

[54] INITIATING ELEMENT FOR NON-PRIMARY EXPLOSIVE DETONATORS

[75] Inventors: Vidon Lindqvist, Gärdesvägen; Lars-Gunnar Löfgren, Rävbergsvägen; Tord Olsson, Hälleforsvägen, all of Sweden

[73] Assignee: Nitro Nobel AB, Nora, Sweden

[21] Appl. No.: 32,193

[22] Filed: Mar. 15, 1993

Related U.S. Application Data

[63] Continuation of Ser. No. 420,512, Oct. 12, 1989, abandoned.

[30] Foreign Application Priority Data

Oct. 17, 1989 [SE] Sweden ..... 88 03683-5

[51] Int. Cl.[6] ..... B30B 7/00

[52] U.S. Cl. ..... 102/205; 102/202.5; 149/92; 149/93

[58] Field of Search ..... 102/202.5, 205; 149/92, 149/93

[56] References Cited

U.S. PATENT DOCUMENTS

| | | | |
|---|---|---|---|
| 2,617,326 | 11/1952 | Morris | 102/322 |
| 2,987,997 | 6/1961 | Ireland | 102/202.3 |
| 3,033,718 | 5/1962 | Preckel | 149/100 |
| 3,109,372 | 11/1963 | Stresau | 102/202.8 |
| 3,118,375 | 1/1964 | Jasse | 102/202.8 |
| 3,212,439 | 9/1965 | Reyne | 102/202.14 |
| 3,724,383 | 4/1973 | Gallaghan et al. | 102/201 |
| 3,978,791 | 9/1976 | Lemley et al. | 102/202.14 |
| 4,050,347 | 9/1977 | Adelman et al. | 149/14 |
| 4,144,815 | 3/1979 | Day et al. | 102/214 |
| 4,170,178 | 10/1979 | Diewald | 102/275.9 |
| 4,239,004 | 12/1980 | Day et al. | 102/202.13 |
| 4,304,614 | 12/1981 | Walker et al. | 149/92 |
| 4,316,412 | 2/1982 | Dinegan et al. | 102/202.5 |
| 4,727,808 | 3/1988 | Wong et al. | 102/202.5 |
| 4,858,529 | 8/1989 | Lieberman | 102/202.5 |
| 4,898,095 | 2/1990 | Tasaki et al. | 102/201 |
| 4,907,509 | 3/1990 | Lieberman | 102/202.5 |
| 4,939,993 | 7/1990 | Curutchet et al. | 102/202.5 |

OTHER PUBLICATIONS

A. F. Belyaev et al, "Transition from Deflagration to Detonation in Condensed Phases", pp. 14–26 and 133–157.

*Primary Examiner*—Edward A. Miller

*Attorney, Agent, or Firm*—Burns, Doane, Swecker & Mathis

[57] ABSTRACT

An initiating element of non-primary explosive type comprising a confinement containing secondary explosive, having a first end adapted for ignition of the secondary explosive by igniting means, optionally via delay and flame-conducting pyrotechnic compositions, a second end adapted for delivering a detonation impuls and a intermediate portion in which the secondary explosive upon ignition is able to undergo a deflagration to detonation transition. At least a part of the secondary explosive is modified to give increased reaction rates at low pressures.

25 Claims, 1 Drawing Sheet

INITIATING ELEMENT FOR NON-PRIMARY EXPLOSIVE DETONATORS

This application is a continuation of application Ser. No. 07/420,512, filed Oct. 12, 1989, abandoned.

TECHNICAL FIELD

The present invention relates to an initiating element for use in detonators of non-primary explosive type, which element comprises a confinement containing secondary explosive and which element has a first end adapted for ignition of the secondary explosive by igniting means, a second end adapted for delivering a detonation impuls and an intermediate portion in which the secondary explosive upon ignition is able to undergo a deflagration to detonation transition.

BACKGROUND

Detonators may be used ms explosive devices per se but are generally used to initiate other explosives. In general terms they have an input end for a triggering signal, customary an electric voltage or the heat and shock from a fuse, and an output end commonly containing a base charge of secondary explosive. Between the input and output ends, means are provided for securing a transformation of the input signal into a detonation of the base charge. In civilian detonators this is generally accomplished by the presence of a small amount of primary explosive adjacent the base charge, which primary explosive rapidly and reliably detonates when subjected to heat or shock. On the other hand, the high sensitivity of primary explosives calls for severe safety precautions in detonator manufacture and use. Primary explosives cannot be transported in bulk but has to be locally produced at each detonator plant. In addition to the high relative manufacturing costs in small units, most primary explosives entail handling of poisonous or hazardous substances. Within the plant the explosive has to be treated and transported in small batches and final dosage and pressing has to be performed by remotely operated devices behind blast shields. In the detonator product the presence of primary explosive is a potential cause of unintentional detonation during transport and use. Any damage, impact, heat or friction at the primary explosive site may trigger the detonator. The primary explosive may also pick up the shock from a neighboring detonation and cause mass detonation in closely arranged detonators. For these reasons strict vernmental regulations are placed on detonator transports. On-site handling are subjected to similar restrictions.

Efforts have been made to replace the primary explosives with the much less dangerous secondary explosives used for example in the base charges. A non-primary detonator should simplify manufacture, permit free transportation including transportation on aircrafts and reduce use restrictions, e.g. allowing concurrent drilling and charging operations.

Igniting devices of the exploding wire or exploding foil type, for example according to the French patent specification 2 242 899, are able to produce a shock of sufficient strength to directly induce detonation in secondary explosives when exposed to high momentary electic currents. They are normally not suitable in civilian applications since expensive and elaborate blasting machines are required and since they are compatible with ordinary pyrotechnical delay devices.

Another type of non-primary explosive detonators, as represented by U.S. Pat. Nos. 3,978,791, 4,144,814 and 4,239,004, suggests use of initiated and deflagrating secondary explosive for acceleration of an impactor disc to impinge on an acceptor secondary explosive with sufficient velocity to detonate the acceptor explosive. To withstand the forces involved the designs are large and mechanically complicated and not entirely reliable.

Still another type of non-primary explosive detonators, as represented by the U.S. Pat. No. 3,212,439, utilizes the ability of ignited and deflagrating secondary explosives to spontaneously transit form deflagration to detonation under suitable conditions. These conditions normally include heavy confinement of rather large amounts of the explosive, which adds to cost and size when compared to conventional primary explosive detonators.

Broadly, successful commercialization of these known types of non-primary explosive detonators have been restricted by by at least two circumstances. The first is the requirement for complex design or heavy confinement, which adds to both material and manufacturing cost when regular production equipments cannot be used. Out of standard size represents an additional cost also for the user. Secondly, while it is possible to obtain some function with various non-primary detonator designs, it is very difficult to reach the very high initiation reliability of primary explosive detonators. Such a high reliability is required by the customers in order to avoid the dangerous task of dealing with an undetonated borehole charge.

Improvements in the above aspects meet partially contradictory requirements. Reduced confinement may reduce also reliability in function or at least limits operational tolerances which adds to manufacturing rejection and control costs. A simple and small design of the detonator part where deflagration to detonation take place may require more elaborate igniting means to establish rapid and reproducible deflagration.

The U.S. Pat. No. 4,727,808 dicloses a new kind of non-primary explosive detonator based on a deflagration to detonation transision of a secondary explosive. The design described can be ignited by most kinds of conventional igniting means, can be manufactured by use of conventional detonator cap equipments, can be housed in normal detonator shells and can be reliably detonated with only slight confinement of the secondary explosive charge. Initiation reliability can be further improved, however, especially at extreme conditions.

SUMMARY OF THE INVENTION

A main object of the present invention is to provide an initiating element for a non-primary explosive detonator which obviates the disadvantages of hitherto used devices. More particularly, an object of the present invention is to provide such an element with high reliability in the deflagration to detonation transition. Another object is to reach a high reliability at extreme conditions. A further object is to secure a rapid and reliable deflagration in the secondary explosive of the element when using simple, mainly heat-generating, conventional igniting means. Still another object is to establish deflagration and detonation in a relatively small amount of secondary explosive. Yet another object is to provide an initiating element of small size and uncomplicated design. Another object is to enable manufacture of the element, and a detonator containing the element, at low cost employing ordinary equipments for primary explosive detonators.

These objects are reached by the characteristics set forth in the appended claims.

By utilizing in the element a porous secondary explosive modified with a combustion catalyst, reaction speed can be increased selectively at crucial parts of the reaction process. Generally combustion catalysts are believed to have their most pronounced influence on reaction speed at low pressures where gas phase transport of reactants are rate determining for overall reaction speed. For the present purposes this property is exploited to limit the critical first period of reaction acceleration up to deflagration or near detonation velocities. If this period is too extended, the pressure forces involved may disrupt the detonator structures ahead of the reaction event and halt further progress. The shortened period obtained by the present suggestions can be exploited to reduce confinement size, limit physical length or width of secondary explosive column, allow larger openings in the confinement, e.g. to facilitate ignition, or improve reliability and redundancy in general. The combustion catalyst additive also acts to flatten reaction temperature dependence, resulting in a markedly broadened range of operable temperature conditions for the detonator. The additive acts to lower the minimum pressure level at which stable linear burning can be sustained in the secondary explosive, which otherwise may not reach atmospheric pressure. This reduces the requirements for pressure generation in igniting means and delay devices and purely heat-generating components may be employed. Full function can be expected also in situations where detonator damage and gas leakage has been caused by the igniting means themselves. In addition, catalysts are observed to improve storage stability and conductivity properties in the secondary explosive charge.

By utilizing in the element a secondary explosive modified to the form of particles of granulated explosive crystals, significant improvements in charge ignition properties can be reached. The granulated particles expose to the igniting means a multifaceted microstructure with substantial specific surface, promoting rapid ignition without need for sustained heat generation by the igniting means. The granulated material porosity facilitates lateral expansion of the initial ignition point into a stable flat convective front. These properties serve to eliminate prolonged and variable igniting stages, which otherwise may affect both detonator time precision and detonator integrity, as described above. In manufacture the free-flowing characteristics of the granulated material facilitates dosage and pressing and its compressibility supports formation of the preferred density gradients, progressively increasing from the initiation end and onwards. In accordance with a preferred embodiment, a first part of the secondary explosive is optimized for ignition purposes and is composed of granulated material while a second part is optimized for high reaction rates and is composed of fine crystalline material, the latter structure supporting higher densities, steeper gradients and better charge integrity. The aggregated adaptions proposed give marked improvments in reliability performance and can be utilized as such or combined with a combustion catalyst as described.

Further objects and advantages will be evident from the detailed description of the invention hereinbelow.

BRIEF DESCRIPTION OF THE DRAWING

For a fuller understanding of the invention, reference should be made to the following Detailed Description and the drawing, wherein.

DETAILED DESCRIPTION OF THE PREFERRED EMBODIMENTS

Figure 1:
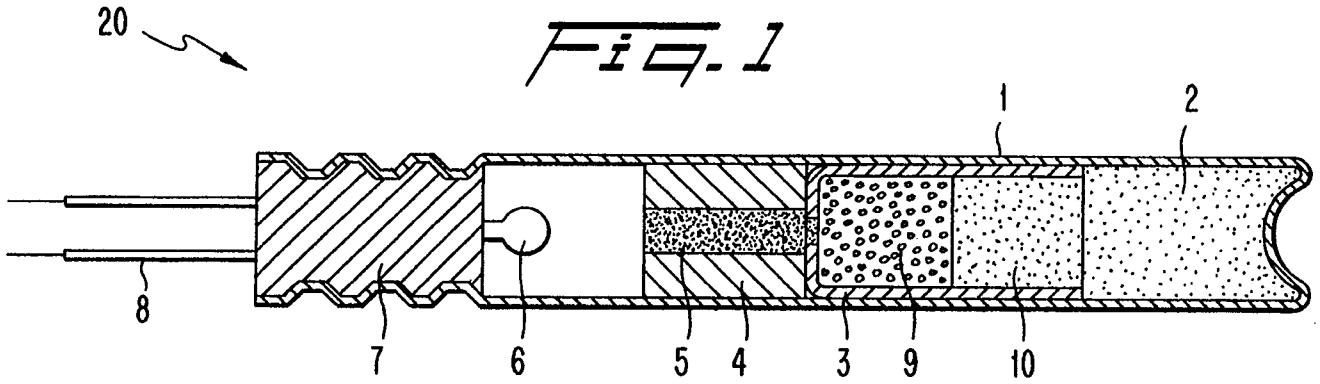
FIG. 1 is one embodiment of the initiating element of the invention as employed in a detonator.

The principles discussed herein can be utilized whenever it is desirable to affect the reaction pattern for secondary explosives in the manners disclosed, e.g. in the various detonator designs initially described. It is preferred, however, to employ the principles in connection with the specific type of non-primary explosive detonators relying on a deflagration to detonation transition (DDT) mechanism, which rests on the ability of a deflagrating secondary explosive to spontaneously undergo a transition into detonation under suitable conditions. The invention will be described primarily in connection with elements using this type of mechanism.

The distinction between primary and secondary explosives is well known and widely used in the art. For practical purposes a primary explosive can be defined as an explosive substance able to develop full detonation when stimulated with a flame or conductive heating within a volume of a few cubic millimeters of the substance, even without any confinement thereof. A secondary explosive cannot be detonated under similar conditions. Generally a secondary explosive can be detonated when ignited by a flame or conductive heating only when present in much larger quantities or within heavy confinement such as a heavy walled metal container, or by being exposed to mechanical impact betwen two hard metal surfaces. Examples of primary explosives are mercury fulminate, lead styphnate, lead azide and diazodinitrophenol or mixtures of two or more of these and/or other similar substances. Representative examples of secondary explosives are pentaerythritoltetranitrate (PETN), cyclotrimethylenetrinitramine (RDX), cyclotetramethylenetetranitramine (HMX), trinitrophenylmethylnitramine (Tetryl) and trinitrotoluene (TNT) or mixtures of two or more of these and/or other similar substances.

For the present purposes any of the abovesaid secondary explosives can be used although it is preferred to select more easily ignited and detonated secondary explosives, in particular RDX and PETN or mixtures thereof. Different initiating element parts may contain different secondary explosives. If the element is broadly divided into a deflagration section and a detonations section, with the proviso that the exact location of the transition point may vary and that the section division need not correspond to any physical structure in the element, it is preferred to use the more easily ignited and detonated explosives at least in the deflagration section while the explosive in the detonation section may be more freely selected.

In addition to the specific additives made in accordance with the present invention, normal additives can be included, such as potassium perchlorate or metals such as aluminum, manganese or zirkonium powder for modification of sensitivity and reaction properties.

A preferred embodyment of the invention incorporates in the element a secondary explosive modified with a combustion catalyst. A main purpose of the addition is to affect the reaction rate at low pressures, e.g. up to about 200 bars, better up to about 500 bars or even up to about 1000 bars. In these pressure ranges the reaction rate is approximately modelled by the equation of Vieille, $r=Ap^{N}$, where r is the rate of burning normal to the burning surface, p is the pressure, N is the pressure exponent and A is a rate constant.

One desired influence in said pressure range is a general increase in reaction rate expressed as an increase in the rate constant (A), e.g. with at least 10%, better with at least 50% and preferably with at least 100%, in order to facilitate rapid formation of a stable linear burning front. It is suitable that the rate constant is sufficiently high for the composition to sustain a stable linear burning at a Constant atmospheric pressure. Another desired influence is a high pressure dependence in order to have a reaction rate avalanche with increasing pressure in the confinement, for rapid acceleration of the initial reaction. For this purpose the pressure exponent (N), measured as a linear approximation in the pressure range considered, should be clearly above zero, better above 1 and preferably above 1.5. Differently expressed, it is suitable that the catalyst addition does not lower the pressure exponent for the secondary explosive without catalyst and preferably increases the exponent with at least 10% or better with at least 50% and preferably with at least 100%. Still another desired influence is an increased reaction rate at low temperatures, and preferably a generally reduced temperature dependence for the reaction rate, in order to obtain reliable and reproducible performance at different operating temperatures. Temperature dependence, expressed as dA/dT, where A is the rate constant and T the temperature, may be reduced by at least 10%, better by at least 50% and is preferably reduced by at least 100% when adding the catalyst.

Many compounds can be used to reach the abovesaid results and the invention is not restricted to any particular compound or combination of compounds. A general method of evaluating the suitability of a catalyst for the present purposes is to determine the A and N constants in the Vieills equation for the secondary explosive, with and without the catalyst addition respectively, and observing the improvement obtained. A standard measuring technic is to burn the composition under study in 1 closed pressurized vessel of a volume large enough to give a roughly constant pressure during the reaction. Reaction time is measured and gives the reaction rate at that pressure. Plotting several reaction rates against their respective pressures in a logaritmic diagram will give a value for the constant A at standard pressure and a value for constant N based on inclination of the rate to pressure curve, in this case approximated to a straight line. Temperature dependence can be determined by repeating these measurements at several different initial temperatures for the compositions. By the method outlined any catalyst candidate can be evaluated for proper properties in view of the guidelines given.

Catalyst candidates are disclosed in the art of propellents where an increase of reaction rates often is a partial although not predominant goal. The U.S. Pat. No. 3,033,718, incorporated herein by reference, and abundant subsequent patents, disclose propellent catalyst compositions which may be used as described or after screening with regard to the considerations given hereinabove. Unlike propellents, an unrestricted acceleration of reaction rates is an advantage in explosives for the present purposes and high values for the A and N constants mentioned and porosities for exposing large burning surfaces are typical adaptions in the present connection.

Catalyst examples are carbon, kryolites, compounds of metals such as aluminum or manganese or preferably heavy metals such as iron, cobolt, nickel, mercury, silver, zing or, in particular, lead, chromium and copper. Organic compounds of the metals are preferred. The compounds generally influence the reaction pattern in more than one way but as a non-limiting suggestion may be said that carbon powder increase the value of constant A, the kryolites reduces temperature dependence and metal compounds may affect constant A or N. Catalyst mixtures are preferred for combined results.

The desired intimate mixture of catalysts and expolosive can be obtained by treating explosive crystals with catalyst solution or suspention but is preferably made by dry-mixing the components, both suitably fine-grained as will be described for granulated material. The amount of catalyst can usually be kept low, such as between 0.1 and 10 percent by weight of the mixture or preferably between 0.5 and 5 percent.

A preferred embodyment of the invented element incorporates secondary explosive modified to particulate granulated form. The granules are formed of a plurality of primary particles, held together in clusters with certain inherent cohesion and mechanical strength.

The primary particles of the secondary explosive should have a fine-grained particle size in order to expose a large specific surface to the gas phase at the ignition and early deflagaration stages. The weight average particle size should be below 100 microns, better below 50 microns and preferably even below 20 microns. Very small particles may result in too compact granules and weight average sizes in excess of 0.1 microns are preferred and also in excess of 1 microns in order to reduce manufacturing problems. Any shape of the primary particles may be used although single crystals, or assemblies of only few crystals, are preferred. A suitable primary particle product may be obtained by grining larger particles or preferably by precipitation from solution, in accordance with known practice, in order to recover a product of narrow size distribution.

Various method can be used to assemble the primary particles into clusters or granules of the desired size and shape. The primary particles can be adhered entirely without a binder by forming and drying a wet cake of from a suspension in a non-solvent for the particles. Addition of a binder to the suspension improves final coherence between the particles. Suitable binders are polymers, soluble or suspendable in the suspension media, such as polyvinylacetate, polymetacrylate or polyvinylalcohol. The flegmatizing influence of the binder is reduced if a self-explosive or self-reacting compund, such as polyvinylnitrate or nitrocellulose, is selcted for binder. The binder is suitably added dissolved in a non-solvent for the secondary explosive, such as ethylacetate. The binder amount should be kept low in order to retain the ability to disintegrate and compact the granules by forces applied in subsequent manufacturing steps. A suitable binder amount is between 0.1 and 10 percent by weight of the granulated product and preferably betwen 1 and 5 percent. Granule size and shape can be affected by carefully grining a dry cake or by forcing it through a sieve, the latter method allowing preparation of elongated granules. Alternatively, simultaneous drying and agitation will form spherical granules of controlled size. Granule weight average sizes between 10 and 2000 microns and preferably between 100 and 500 microns are suitable. Unreproducible element conditions are caused by too large particles and too small granules may result in insufficient charge porosity.

In case optional particulate additives, conventional or catalysts as disclosed, shall be present in the charge, they are preferably, for best free surface intimacy, included in the granulated material by forming part of the primary particles mass, although conceivable possibilities are also separate addition of the additive particles to the charge bed or their inclusion in the primary particles themselves.

As above indicated, the explosive material described shall be included in an initiating element with a confinement for the secondary explosive, having a first end adapted for ignition of the secondary explosive by igniting means, optionally via delay or flame-conducting pyrotecnic compositions, a second end adapted for delivering a detonation impuls and an intermediate portion in which the secondary explosive upon ignition is able to undergo a deflagration to detonation transition. A preferred general layout of the element is disclosed in the previously mentioned U.S. Pat. No. 4,727,808, incorporated by reference herein.

The drawing generally illustrates two embodiments of the invention. The drawing is not intended to be made to scale. In both FIGS. 1 and 2, a detonator is indicated generally by the number 20. A detonator shell 1 contains a base charge 2. The initiating element 3 is positioned between the base charge 2 and a delay element 4. The delay element contains a delay charge 5. A fusehead 6 is positioned in one open end of the detonator and sealed via a sealing plug 7. Electrical lead wires 8 are connected to the detonator 20. The initiator includes granulated secondary explosive 9 at the end adjacent the delay element 4, and crystalline secondary explosive 10 at the other end adjacent the base charge.

Figure 2:
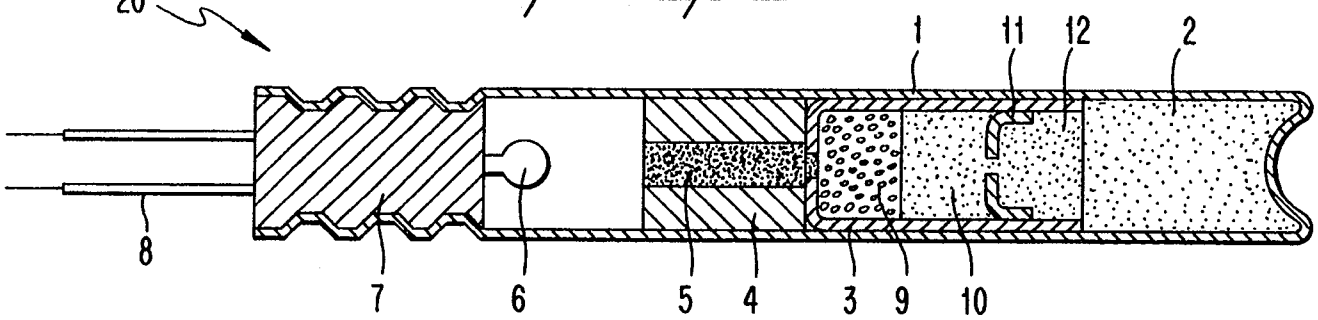
FIG. 2 is another embodiment of the initiating element of the invention as employed in a detonator.

The embodiment of FIG. 2 contains, in addition, a wall shaped cup 11 in the initiating element 3 and an intermediate charge 12 of crystalline secondary explosive. The intermediate charge 12 can have a different density than the secondary explosive 9.

The element shall contain an initiating charge in which the reaction speed is accelerated to detonation or near detonation velocities. This charge shall contain modified secondary explosive in order too reach the stated advantages. Preferably the initiating charge portion adjacent the first end of the element, or the portion subjected to ignition and where low pressures are prevailing, say below about 500 bars, shall contain materials of the invention. It is further preferred that the remaining portion of the initiating charge or the portion closer the second end of the element contains less or no modified secondary explosive, and preferably contains or consists of crystalline material for reasons set out hereinabove. Suitable crystalline materials may have the same size characteristics as discussed for granulated material. It is also preferred that this portion has a lower and preferably no content of combustion catalysts. The explosive weight ratio in the two portions is suitably in the range between 1:5 and 5:1, preferably between 1:2 and 2:1.

Overall pressing density for the initiating charge is suitably in the range of between 50 and 90% of the crystal density for the explosive used and preferably between 60 and 80% of said density. Advantageously the initiating charge has a gradient of increasing pressing density from the first end and onwards. Preferably the the gradient is non-linear and have accelerating increase with charge length. Density in the lower density end may be between 10 and 50, preferably between 20 and 40%, of crystal density and in the higher density end between 60 and 100%, preferably between 70 and 95%. The desired density profile can be obtained by incremental pressing of the charge. By preference, however, the entire initiating charge is formed in a substantially one-step pressing operation, which will result in an increasing density gradient if the pressure force is applied in the reverse direction. Whatever method used, the granulated material suggested will promote formation of a low density charge end of high porosity and progressively higher densities under compaction and partial disintegration of the granules. In the high density end the best properties and steepest gradients are attained by the preferred inclusion of crystalline material in the charge.

An initiating charge of sufficient length and configured as described will permit the secondary explosive to complete the transition from deflagration to detonation and the element to deliver a detonation impuls. The high density end of the initiating charge may then coincide with the abovesaid second end of the element. A generally smaller element of improved reliability performance is obtained if, according to a preferred practice of the abovesaid US reference, an intermediate charge is disposed between the initiating charge and the second end, or after the initiating charge in the explosive material train. A pressing density drop, when seen in the reaction direction, shall be present in the boundary between initiating charge and intermediate charge and preferably the intermediate charge has a lower overall density when compared to the average density of the initiating charge. The average density for the intermediate charge may be in the range between 30 and 80% of the crystal density for the explosive used and preferably between 40 and 75% of said density. Like in the initiating charge, a gradient of increasing pressing density towards the output end is preferably present in the intermediate charge. Incremental pressing can be used to control density but a single-step method facilitates manufacture and give homogeneous gradients, the preferred procedure being to force an openended element, with the initiating charge already present, into a bed of secondary explosive for the intermediate charge. This explosive preferably contains or consists of crystalline material as described to promote formation of the desired density profile and as reaction velocities here are believed to be too high to benefit from influence of combustion catalysts or granulated material.

Again in accordance with abovesaid reference, a thin wall is preferably present in the boundary between initiating and intermediate charges for retaining the charges and promoting a distinct detonation transition. The wall is suitably of metal and less than 1 mm and even less than 0.5 mm in thickness and may contain an aperture, or a recess for an aperture, to facilitate penetration. The wall may be integral with the element itself but is preferably a separate cup or disc, slightly oversized in relation to the element interior to secure its retention under all operating conditions, and is preferably inserted in connection with the initiating charge pressing operation.

The main confinement of the element shall enclose at least the initiating charge and preferably also the intermediate charge when present. The confinement may be a substantially cylindrical tube of strong material, such as steel, brass or perhaps aluminium with a wall thickness below 2 mm or even below 1 mm. The diameter may be less than 15 mm, or less than 10 mm, and may be adapted to the size of a detonator shell.

While the second end of the confinement may embrace some additional axial confinement, such confinements are preferably omitted as superfluous. The first end, however, is preferably provided with axial confinement in addition to radial confinement in order to support rapid pressure build-up under the critical first stages in the reaction. Any structure able limit reaction gas losses is usable for this purpose. An impervious slag column from pyrotecnical compositions, delay compositions in particular, may serve this purpose. Delay composition elements, when used, preferbly have a reactant column more narrow than the secondary explosive column of the initiating charge. Optional delay, flame-conducting or other compositions can be positioned in- or outside the physical limits of the element main confinement. Alternatively, axial confinement may include a wall, which can be separate from, but preferably is integral with, the main confinement. The first end may be entirely closed. In this case arrangements have to be provided to include igniting means within the enclosure, to allow ignition over the closed wall by for instance heat or percussion means or to arrange a valve allowing forward signalling and gas-flow only. It is preferred to include a hole in the first end confinement, however, to simplify ignition with ordinary igniting means, the pressure loss being acceptable when the principles of the invention are utilized. The hole can be provided directly at the element first end, adjacent the initiating charge, or at any pyrotechnical device interposed between the element first end and the igniting means.

Although the element has been described as a cylidrical structure, it is obvious that other confinement shapes of corresponding strength properties are within the scope of the invention.

The igniting means provided somewhere before the element first end in the reaction train can be designed and selected very freely for reasons set out above. Any conventional type can be used, such as an electrical fusehead, safety fuse, detonating cord, low energy detonating cord, hollow channel low energy fuse (e.g. NONEL, registered trade mark), exploding foils or films, laser pulses delivered through optical fibres, electronic devices etc. Preferred are the mainly heat generating devices.

The element embodied herein may be used as an independent explosive device for various purposes or may be included in igniters, detonators, primers etc. Its principal use, however, is in in civilian detonators, which typically includes a hollow tube with a secondary explosive base charge in one end, an opposite open end provided with or for the insertion of igniting means as described and an intermediate portion containing at least a priming device and optionally also delay or flame-conducting components. In such detonators the present initiating element is intended to constitute the priming device, transforming the initial low speed signal into a detonation for detonating the base charge. An ordinary priming device of primary explosive can simply be substituted by the present element, with its second end facing the base charge, with optional intermediate charges, and its first end facing the igniting means, with optional intermediate devices. The element confinement can be integral with the detonator shell tube but is preferably separate structure inserted into the tube, for which purpose element external surface may correspond to tube interior surface.

A detonator of the described kind may be maufacured by separately pressing the base charge in the bottom of the detonator shell tube with subsequent insertion of the element in abutting relationship to the base charge, although it is also possible to press the base charge by use of the element. Above the element is optionally inserted a delay element, preferably with an ignition or flame-conducting pyrotecnical composition between delay element and initiating element. The igniting means are inserted in the open end of the shell tube, which is sealed by a plug with signalling means, such as a fuse tube or electrical wires, extending therethrough.

The detonator of the invention may be used in any area suited for conventional detonators although its improved reliability and safety is considered to further expand uses into new competitive areas.

The invention will be further enlightened in the following illustrative but non-limiting examples.

EXAMPLE 1

A granulated product of PETN was prepared by wet-grinding 200 g coarse PETN crystals for 8 hours in a laboratory ball mill. The crystals were separated from the water and dried overnight at 70 degrees centigrades. Crystal size was between 2 and 20 microns. About 3 g polyvinylacetate was dissolvend in about 100 grams ethylacetate and the solution was added to the crystals. The paste obtained was pressed through a 35 mesh sieve and the elongated granules obtained were dried overnight at 70 degrees centigrades. Over- and undersized particles were removed by screening. The granules obtained had a size of about 2 mm×0.5 mm.

An deep-drawn initiating element of low carbon content steel material was prepared, having a length of 23 mm, an outer width of 6.4 mm and a wall thickness of 0.6 mm. One element end having a constriction leaving a hole of 2.5 mm. About 300 mg of a pyrothecnical delay composition containing lead oxide, silicon and a binder was pressed into the restricted end of the element with a force of about 2500N. About 280 mg of the above described granulated material was filled into the element above the delay charge and pressed with a force of about 1400 N, an aluminium cup disposed between the presspin and the charge being simultaneously forced into the element, the cup having a thickness of about 0.3 mm and having a central recessed region of about 0.1 mm thickness. Average density of the initiating charge explosive was about 1.25 g/cc.

A detonator shell of 74 mm in length and 7.5 mm in outer diameter was filled in its closed end with 700 mg base charge of RDX/wax in a ratio of 95/5 and pressed with a force of 3000N to a final density of about 1.5 g/cc. About 200 mg of the granulated material was loosely filled into the shell above the base charge and pressed by forcing the initiating element, with its open, cup-equipped, end towards the base charge, with about 800N to give ultimate average density in the intermediate charge, between base charge and initiating charge, of about 1.0 g/cc.

A standard electrical fusehead was inserted and sealed into the open end of the detonator shell. Out of 1000 so prepared detonators 995 detonated properly when shot.

EXAMPLE 2

An initiating element structure of the type described in Example 1 was first filled with delay composition as described. Then 140 mg of the granulated material described in Example 1 and 140 mg of crystalline PETN, having a particle size of about 200 microns, were filled above the delay charge and was pressed with an aluminium cup as described to the same average final density. For intermediate charge between base charge and initiating charge was used 200 mg of the same crystalline material as above. Detonators were finished as in Example 1 and 1000 detonators were shot with no failures.

EXAMPLE 3

An initiating element was prepared from common constuction steel, cut from standard tube and open in both ends, with a length of 17 mm and a diameter of 6.4 mm. Into the element was charged 140 mg of granulated material and 140 mg of crystalline material as described and pressed with a cup to about the same final density as in Example 2. The element was forced into a detonator shell with base charge and loose explosive to form an intermediate charge as described. After insertion of the element, about 100 mg of a flame-conducting composition was filled above the element and a delay element, with a length of 9 mm and internal dimetar of 3 mm filled with the same compositon as described in Example 1, was forced against the initiating element with about 2000N. A low energy fuse tube of Nonel (Registered Trade Mark) was inserted and sealed into the open detonator shell end. 4000 detonators of this kind were shot without failures.

EXAMPLE 4

A granulated product was preapred as described in Example 1, with the distinction that to the 200 g of coarse PETN was added, before grinding, about 2 g lead stearate, 1 g dichrometrioxide, 1 g potassium kryolite and 0.2 g carbon black. This mixture was ground and granulated as described in Example 1.

Ready detonators were prepared as described in Example 2 but with Nonel (Registered Trade Mark) as igniting means. At a temperature of minus 30 degrees centigrade 18 detonators were shot. No failures were registered.

EXAMPLE 5

Detonators were prepared as in Example 4 but with use of the granulated product of Example 1 instead of the granulated material described in Example 4. The detonators were shot at minus 30 degrees centigrades. Out of 18 detonators two failed to detonate.

EXAMPLE 6

The granulated material of Example 1 and the granulated material of Example 4 were formed into two sparate and freely positioned strands of about 2 mm height on a flat surface. Both strands were ignited with a hot flames. The material of Example 1 was unable to burn unsupported by the flame while the mateiral of Example 4 after ignition burnt steadily to the end of the strand.

We claim:

1. A non-primary explosive detonator comprising a hollow tube with a secondary explosive base charge in one end, an opposite end provided with heat generating igniting means, and an initiating element comprising a confinement containing secondary explosive material, said initiating element having (a) a first end which faces the igniting means and which contains secondary explosive material and is adapted for ignition of the secondary explosive material by the igniting means,;

(b) a second end facing the base charge and being adapted for delivering a detonation impulse; and (c) an intermediate portion comprising a deflagration section adjacent said first end and a detonation section adjacent said second and in which the secondary explosive material of the element, upon ignition, is adapted to undergo a deflagration to detonation transition;

wherein at least the secondary explosive material located in said first end and in said deflagration section of the initiating element is in the form of a porous granulated material, the granules thereof having a weight average particle size between 10 and 2000 microns, and made up of a plurality of primary crystals having a weight average particle size between 0.1 and 100 microns, the crystals being held together in clusters.

2. The detonator of claim 1, wherein said first end and said deflagration sections further comprise a combustion catalyst mixed with said secondary explosive material.

3. The detonator of claim 2, wherein the catalyst is present in an amount of between 0.1 and 10 percent by weight of the mixture.

4. The detonator of claim 2, wherein said catalyst is in the form of a fine-grained powder.

5. The detonator of claim 2, wherein the granules comprise secondary explosive material having said combustion catalyst incorporated therein.

6. The detonator of claim 2, wherein said catalyst is selected from the group consisting of carbon, kryolites and compounds of aluminum, manganese, iron, cobalt, nickel, mercury, silver, zinc, lead, chromium, copper, and mixtures of the above.

7. The detonator of claim 1, wherein said primary crystals making up the granulated material have a weight average particle size between 1.0 and 50 microns.

8. The detonator of claim 1, wherein said granulated material comprises a binder for the secondary explosive crystals in an amount between 0.1 and 10% by weight of the granulated material.

9. The detonator of claim 1, wherein said granules have a weight average particle size between 100 and 500 microns.

10. The detonator of claim 1, wherein said second end of said element includes crystalline or crushed granulated secondary explosive material.

11. The detonator of claim 1, wherein the initiating and intermediate charges are separated by a stepwise drop in pressing density from the first end to the intermediate portion.

12. The detonator of claim 11, wherein the initiating charge contains granulated secondary explosive adjacent the first end and crystalline material adjacent the intermediate portion.

13. The detonator of claim 12, wherein the weight ratio of granulated secondary explosive material to crystalline material is between 1:5 to 5:1.

14. The detonator of claim 11, wherein the element has a pressing density gradient in the initiating charge, increasing in direction from the first end towards the second end.

15. The detonator of claim 11, wherein the element has an average pressing density of said secondary explosive material of said element of between 50 and 90% of the density of said secondary explosive material in crystal form.

16. The detonator of claim 11, wherein the intermediate portion contains crystalline material.

17. The detonator of claim 11, wherein the element has a pressing density gradient in the intermediate portion, increasing in direction from the first end of the initiating element towards the second end.

18. The detonator of claim 11, wherein the element has an average pressing density for the intermediate portion of between 30 and 80% of crystal density for the explosive used.

19. The detonator of claim 11, wherein a wall is arranged in the boundary between said secondary explosive material in said first end and said intermediate portion.

20. The detonator of claim 11, wherein said wall is a cup or disc separate from the hollow tube but adhered thereto.

21. The detonator of claim 1, wherein the secondary explosive comprises PETN or RDX.

22. The detonator of claim 1, further including a delay element positioned on the first end of the initiating element.

23. The detonator of claim 22, further including an ignition or flame-conducting pyrotechnical composition between the delay element and the initiating element.

24. The detonator of claim 59, wherein a first portion of the secondary explosive material comprises granulated explosive crystals and a second portion of the secondary explosive material comprises fine crystalline material having a higher density than the granulated explosive crystals.

25. A non-primary explosive detonator comprising a hollow tube with a secondary explosive base charge in one end, an opposite end provided with heat generating igniting means, and an initiating element comprising a confinement containing secondary explosive material, said initiating element having (a) a first end which faces the igniting means and which contains secondary explosive material and is adapted for ignition of the secondary explosive material by the igniting means,;

(b) a second end facing the base charge and being adapted for delivering a detonation impulse; and (c) an intermediate portion comprising a deflagration section adjacent said first end and a detonation section adjacent said second and in which the secondary explosive material of the element, upon ignition, is adapted to undergo a deflagration to detonation transition;

wherein said first end and said deflagration sections further comprise a combustion catalyst mixed with said secondary explosive material.

* * * * *

UNITED STATES PATENT AND TRADEMARK OFFICE

CERTIFICATE OF CORRECTION

PATENT NO. :5,385,098

DATED :January 31, 1995

INVENTOR(S) :VIDON LINDQVIST et al.

It is certified that error appears in the above-indentified patent and that said Letters Patent is hereby corrected as shown below:

On title page,

IN THE "FOREIGN APPLICATION PRIORITY DATA" [30]:

The filing date of Swedish Application 88 03683-5 should be changed from October 17, 1989 to --October 17, 1988--.

Signed and Sealed this

Twenty-fifth Day of April, 1995

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,385,098

DATED : January 31, 1995

INVENTOR(S) : Vidon Lindqvist et al.

It is certified that error appears in the above-identified patent and that said Letters Patent is hereby corrected as shown below:

On the title page, item [73], should read: --Nitro Nobel AB, Nora, Sweden Safety & Environmental Protection Research Institute, Wuhan, People's Republic of China, and China Metallurgical Import and Export Corp., People's Republic of China.

Signed and Sealed this

Sixteenth Day of February, 1999

*Attest:*

*Attesting Officer*

*Acting Commissioner of Patents and Trademarks*